US007511410B2

(12) United States Patent
Bauer et al.

(10) Patent No.: US 7,511,410 B2
(45) Date of Patent: Mar. 31, 2009

(54) PAR LAMP ARRANGEMENT

(75) Inventors: Josef Bauer, Walting (DE); Herbert Fülz, Ingolstadt (DE); Hans-Hermann Gmeiner, Ingolstadt (DE); Thomas Mehr, Dollnstein (DE); Roland Stark, Wellheim (DE); Inge Staudacher, Pollenfeld (DE); Michael Willacker, Germendorf (DE)

(73) Assignee: Osram Gesellschaft Mit Beschraenuter Hattung, Munich (DE)

( * ) Notice: Subject to any disclaimer, the term of this patent is extended or adjusted under 35 U.S.C. 154(b) by 486 days.

(21) Appl. No.: 11/302,153

(22) Filed: Dec. 14, 2005

(65) Prior Publication Data

US 2006/0132016 A1 Jun. 22, 2006

(30) Foreign Application Priority Data

Dec. 17, 2004 (DE) ..... 10 2004 060 918

(51) Int. Cl.
*H01J 5/48* (2006.01)

(52) U.S. Cl. ..... 313/318.01; 313/318.05

(58) Field of Classification Search ..... 313/318.01, 313/318.05, 318.09, 318.11
See application file for complete search history.

(56) References Cited

U.S. PATENT DOCUMENTS

| | | | | |
|---|---|---|---|---|
| 3,417,367 | A | 12/1968 | Dayton | |
| 5,412,274 | A * | 5/1995 | Parham | 313/112 |
| 5,726,525 | A | 3/1998 | Friederichs | |
| 6,053,623 | A | 4/2000 | Jones | |
| 6,075,318 | A * | 6/2000 | Noll et al. | 313/573 |
| 6,340,861 | B1 | 1/2002 | Jakub | |
| 6,471,385 | B1 | 10/2002 | Emunds | |

FOREIGN PATENT DOCUMENTS

| | | |
|---|---|---|
| EP | 0 252 446 | 1/1988 |
| EP | 0 446 460 | 9/1991 |

* cited by examiner

*Primary Examiner*—Vip Patel

(57) ABSTRACT

The subject matter of the disclosure is a PAR lamp arrangement having an integral lamp, in particular an integral halogen lamp, which is inserted into a base and is surrounded at least in sections by a reflector, the base and the integral lamp being connected via contact springs, and the reflector being covered by a diffusing screen. According to the invention, the reflector is made from aluminum and is provided with a reflective surface or coating. Owing to the aluminum reflector used and the fact that the integral lamp is held via contact springs, improved holding of the integral lamp is made possible with reduced weight and production complexity.

8 Claims, 9 Drawing Sheets

PAR LAMP ARRANGEMENT

TECHNICAL FIELD

The invention relates to a PAR lamp arrangement having an integral lamp, in particular an integral halogen lamp, which is inserted into a base and is surrounded at least in sections by a reflector, the base and the integral lamp being connected via contact springs, and the reflector being covered by a diffusing screen. The invention also relates to a base arrangement, in particular for a PAR lamp arrangement.

BACKGROUND ART

PAR (parabolic aluminized reflector) lamps are used in general and professional lighting technology, for example, in disco-lighting or for architectural lighting applications, in large numbers owing to their compact design and cost-effective production.

Such PAR lamps known, for example, from WO 9 217 733 and U.S. Pat. No. 5,199,787 have a reflector body, which is produced from a pressed glass, is coated with aluminum and has a light source inserted therein. The reflector body is typically in the form of a concave paraboloid, the light source preferably being arranged in the focus of the reflector and being closed by a covering disk. Owing to their good light quality and long life, halogen incandescent lamps (halogen burners) with or without envelopes are used increasingly as a light source. The covering disk fitted to the reflector body can be designed to be smooth or designed to have a surface structure, for example to be faceted, for the purpose of influencing the optical properties and is also used as a safety device in the case of a halogen burner breaking.

One disadvantage with the above-described solution is the fact that such PAR lamps have a high weight and are very expensive to produce owing to their complex design and manufacture.

DISCLOSURE OF THE INVENTION

The invention is based on the object of providing a PAR lamp arrangement having an integral lamp, in particular an integral halogen lamp, which has a reduced weight with a simplified manufacturing process.

This object is achieved by a PAR lamp arrangement having an integral lamp, in particular an integral halogen lamp, which is inserted into a base and is surrounded at least in sections by a reflector, the base and the integral lamp being connected via contact springs, and the reflector being covered by a diffusing screen, whereby the reflector is made from aluminum and has a reflective surface or coating and by a base arrangement having a base, into which a contact spring arrangement can be snapped. Particularly advantageous embodiments of the invention are described in the dependent claims.

The PAR lamp arrangement according to the invention has an integral lamp, in particular an integral halogen lamp, which is inserted into a base and is surrounded at least in sections by a reflector, the base and the integral lamp being connected via contact springs, and the reflector being covered by a diffusing screen. According to the invention, the reflector is made from aluminum and is provided with a reflective surface or coating. The aluminum reflector used, which is lighter than a conventional glass reflector, makes it possible to achieve a reduced weight for the PAR lamp arrangement with a simplified manufacturing process.

The reflector is preferably connected to the diffusing screen by deformation, in particular by beading on a circumferential section of a circumferential wall of the reflector, the space delimited by the reflector and the diffusing screen being filled with air, in contrast to the known solutions.

A base arrangement for a PAR lamp arrangement according to the invention preferably has a base, into which a contact spring arrangement is snapped.

In accordance with one particularly preferred exemplary embodiment, the base and the integral lamp are connected via the contact spring arrangement. This contact spring arrangement takes on the functions both of making electrical contact with and of mechanically fixing the integral lamp in the reflector, with the result that separate power supply lines can be dispensed with. The fact that the integral lamp is held via contact springs makes it possible to vary the installation position of the integral lamp in the reflector and thus to adapt it to different designs of integral lamps, for example to different pinch-seal lengths or contact-pin lengths. Furthermore, the fact that the integral lamp is held via contact springs makes improved holding of the integral lamp possible with reduced production complexity.

The compact spring arrangement preferably forms, on the lamp side, a clamping region for the purpose of engaging around a pinch seal of the integral lamp.

The holding of the integral lamp can advantageously be further improved via at least two knob-like projections which are formed in the clamping region and can be brought to bear against two side faces of the pinch seal.

In order to delimit the insertion depth of the integral lamp in the contact spring arrangement, said contact spring arrangement preferably has at least one slot-shaped insertion section, it being possible for at least one knob of the pinch seal of the integral lamp to be inserted into said insertion section and fixed there.

The insertion section is advantageously delimited, on the lamp side, by corner regions which engage behind the knob of the pinch seal and hold the integral lamp in the contact spring arrangement.

In order to make it easier to insert the pinch seal, in one exemplary embodiment the corner regions are bent outwards, on the lamp side, at least in sections.

In one particularly preferred embodiment of the invention, the contact spring arrangement has at least two contact springs for the purpose of making electrical contact with the integral lamp. The contact springs are preferably of identical design, which further reduces the production complexity of the PAR lamp arrangement. The electrically conductive contact springs mean that no additional electrical connections of the integral lamp are required.

The contact springs preferably each form at least one spring tab, which is bent out for the purpose of being connected to the base. The base and the contact springs are in this case designed such that they can be inserted one inside the other and can be connected to one another thereby.

It has proven to be particularly advantageous for the contact springs to be in the form of stamped and bent sheet-metal parts, which have an approximately bracket-shaped cross section, at least in sections.

In accordance with one preferred exemplary embodiment, the integral lamp has two contact pins, which emerge on the underside of the pinch seal and are each provided with a power supply line having an integrated electrical fuse, the power supply lines being passed back in the direction of two planar-parallel surfaces of the pinch seal. Owing to the power supply line which is bent back approximately in the form of a U in the direction of the integral lamp, a low physical height of the integral lamp inserted into the contact spring arrangement is achieved.

The power supply lines are preferably electrically connected, in particular welded or soldered, to contact lugs of the contact springs.

In order to accommodate the power supply lines of an integral lamp which can be inserted into the base, the base preferably has at least one cutout.

In order for the reflector to be held securely on the base, a reflector neck of the reflector and a holding region of the base are preferably connected by plastic deformation, preferably crimping, at least in sections.

The integral lamp can preferably be designed using the knob technique or designed to have a bar frame. Such integral halogen lamps are produced in a cost-effective manner in large numbers for general lighting purposes, as a result of which the production costs of the PAR lamp arrangement according to the invention are further reduced.

BRIEF DESCRIPTION OF THE DRAWINGS

The invention will be explained in more detail below with reference to preferred exemplary embodiments. In the drawing.

BEST MODE FOR CARRYING OUT THE INVENTION

Initially, one exemplary embodiment of a PAR lamp arrangement according to the invention will be explained with reference to FIGS. 1 to 11, in which embodiment the integral lamp is in the form of a halogen incandescent lamp (halogen burner) using the knob technique.

Figure 1:
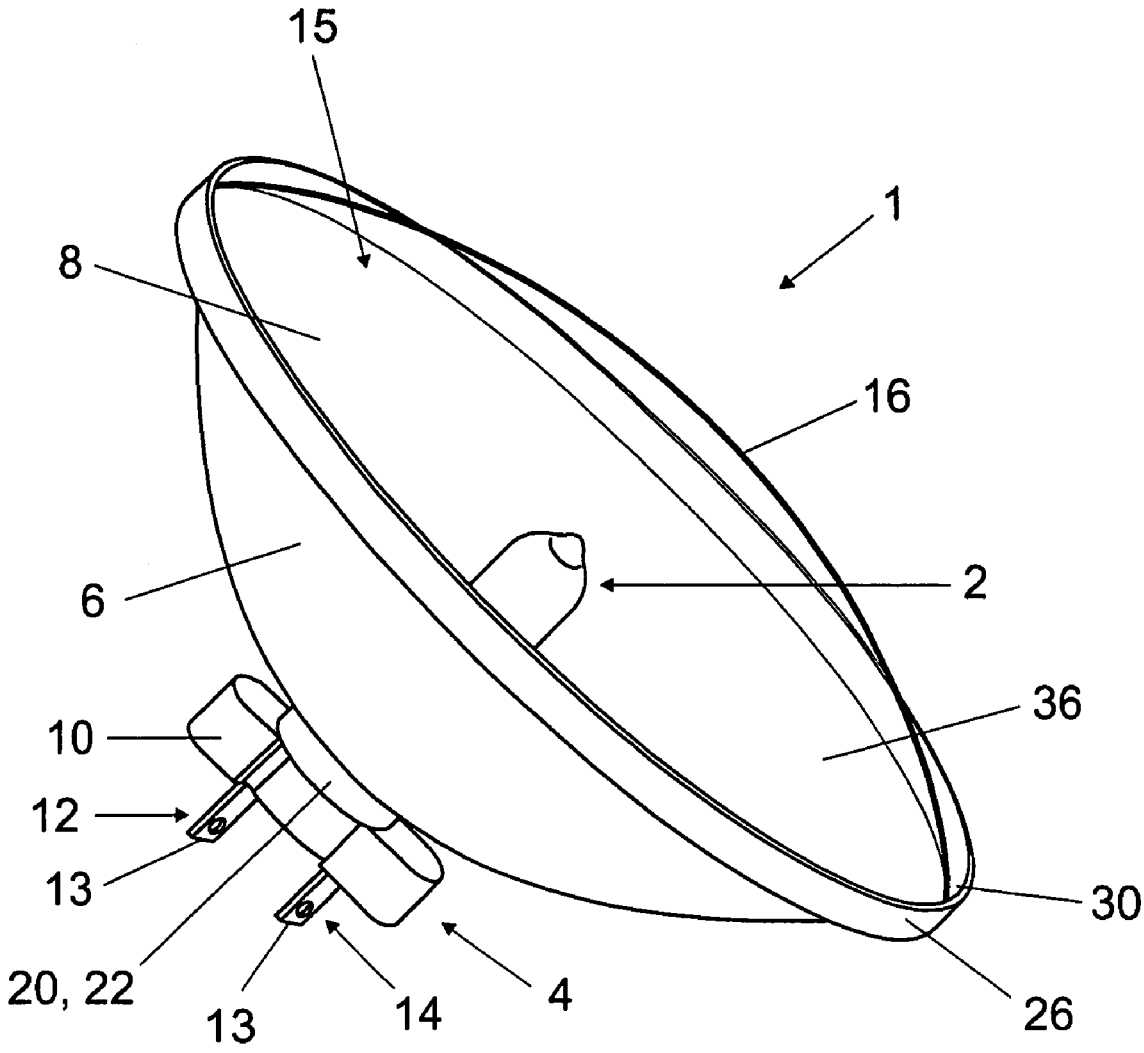
FIG. 1 shows a three-dimensional view of a first exemplary embodiment according to the invention of a PAR lamp arrangement.

FIG. 1 shows a PAR lamp arrangement 1 according to the invention having an integral lamp 2 which is inserted into a base arrangement 4 and is surrounded by a reflector 6. The reflector 6 is made from aluminum and is provided, on its inside, with a reflective coating 8 made from highly pure aluminum (for example degree of purity 99.98), for example by means of mirror-finish anodization. The base arrangement 4 has a ceramic base 10 which, according to the invention, is connected to the integral lamp 2 via contact springs 12, 14, whose end sections 13 protrude downwards from the base arrangement 4. Owing to the aluminum reflector 6, which is lighter than a conventional glass reflector, and the fact that the integral lamp 2 is held via contact springs 12, 14, improved holding of the integral lamp 2 is made possible with reduced weight and production complexity. A reflector opening 15 of the reflector 6 is connected to a transparent diffusing screen 16 and covered by said diffusing screen 16. This will be explained in more detail below.

Figure 2:
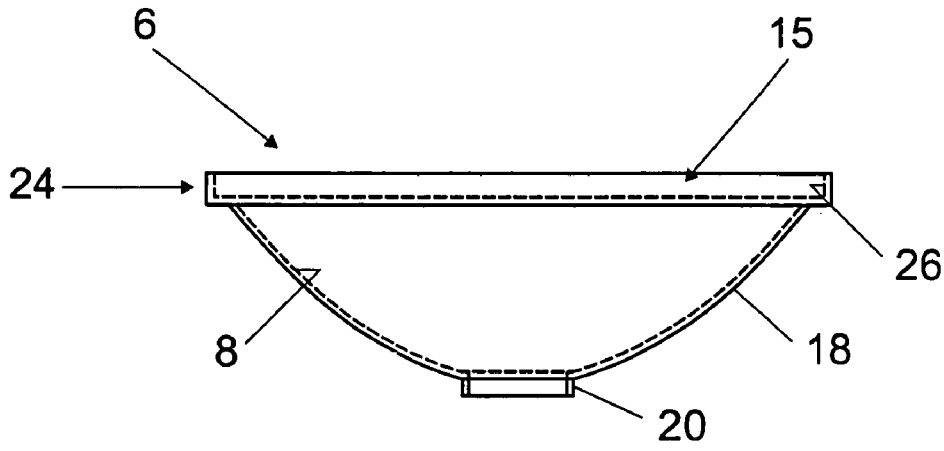
FIG. 2 shows a side view of the reflector in FIG. 1.
Figure 3:
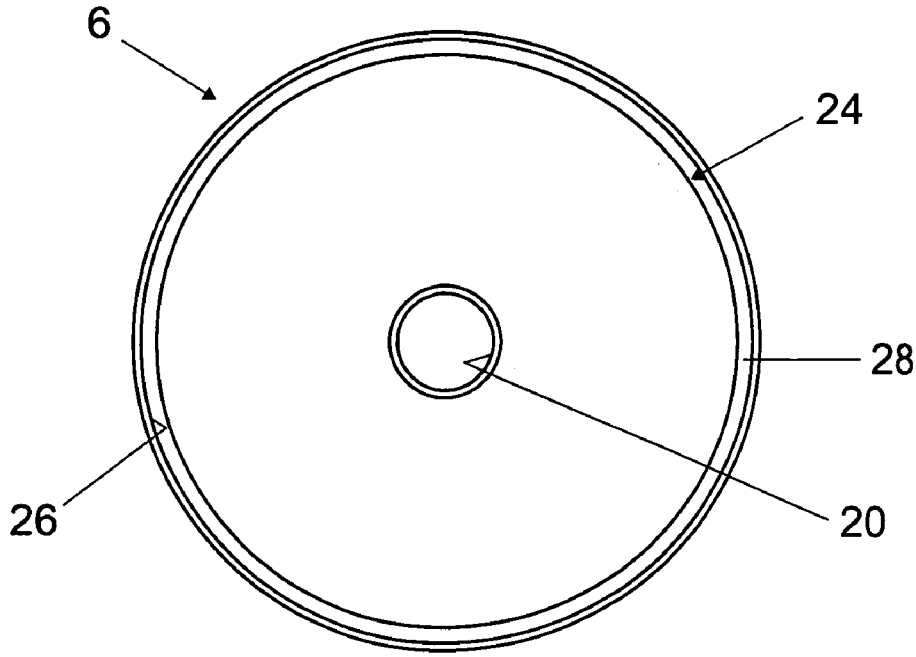
FIG. 3 shows a plan view of the reflector.

As shown in FIG. 2, the reflector 6 has an approximately parabolic cross section 18 which, on the base side, merges with a reflector neck 20 in the form of a cylinder jacket for the purpose of accommodating a cylindrical holding region 22 of the ceramic base 10 and can be connected to said ceramic base 10 by means of crimping (cf. FIG. 1). The reflector 6 merges, on the light-exit side, with a cylindrical accommodating section 24 having a larger diameter and forms a circumferential wall 26 for the purpose of holding the diffusing screen 16 in the reflector opening 15.

Figure 4:
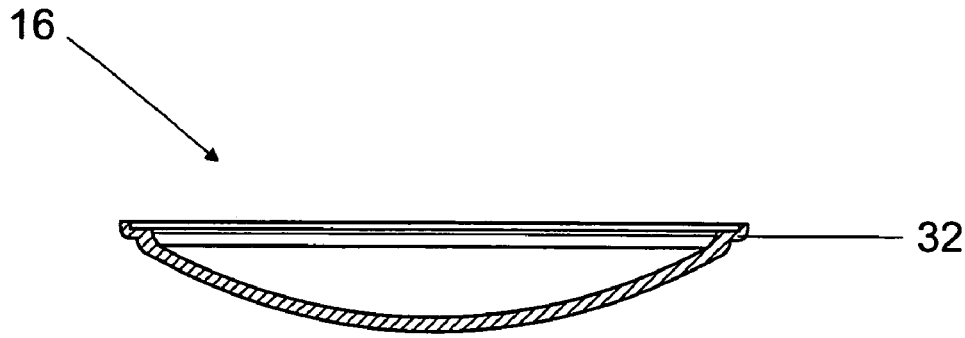
FIG. 4 shows a cross section of a diffusing screen shown in FIG. 1.
Figure 5:
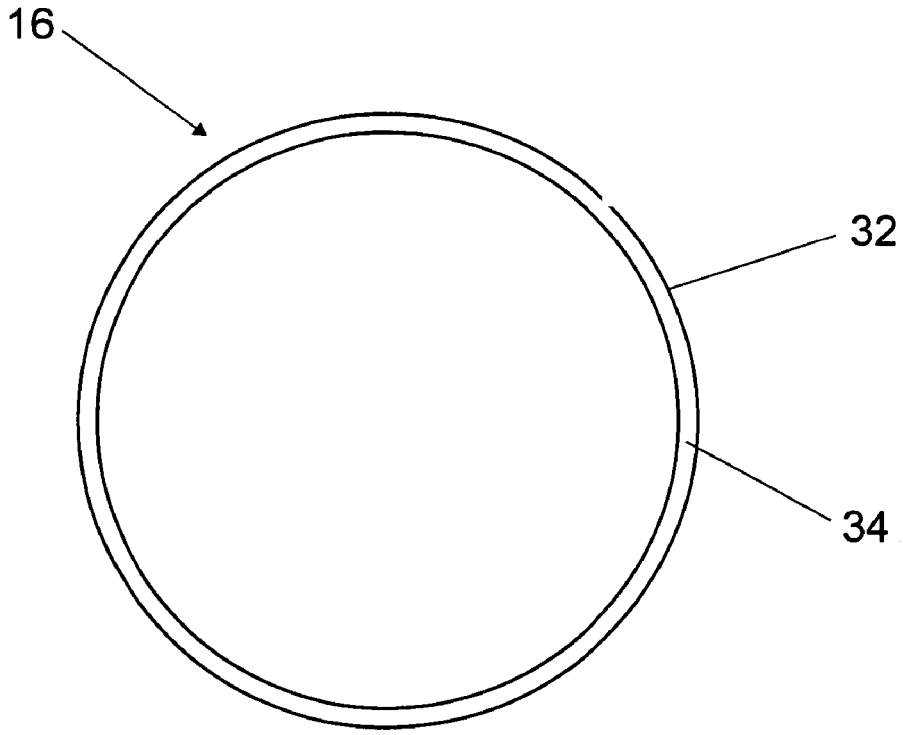
FIG. 5 shows a plan view of the diffusing screen shown in FIG. 4.

As can be seen in particular in the plan view (shown in FIG. 3) of the reflector 6, the accommodating section 24 forms an annular bearing surface 28 for the diffusing screen 16, i.e. the diffusing screen 16 is accommodated in the circumferential wall 26 and is brought to bear against the bearing face 28. By means of beading on a protruding circumferential section 30 of the circumferential wall 26, the diffusing screen 16, as illustrated in FIG. 1, is connected to the reflector 6. For this purpose, a plate-shaped flange 32 is provided on the diffusing screen 16 (which in this exemplary embodiment is spherical), as shown in FIG. 4 and FIG. 5, i.e. the beaded circumferential section 30 of the circumferential wall 26 rests on an annular surface 34 of the flange 32 and fixes the diffusing screen 16 on the reflector 6. Owing to the use of an integral lamp 2, evacuation and sealing of the space 36 delimited by the reflector 6 and the diffusing screen 16 and filled with air (cf. FIG. 1) can be dispensed with in contrast to the known solutions. The diffusing screens 16 used can have any shape known from the general prior art and, depending on the application case and the desired solid angle, for example an obtuse angle for large-area radiation (type FL, flood) or an acute angle for spot radiation (type SP, spot) etc., can be designed to be-smooth or faceted. As an alternative to adjusting the solid angle (emission angle) by means of the diffusing screen 16, this could also take place by means of a faceting of the reflector, and a diffusing screen could be dispensed with.

Figure 6:
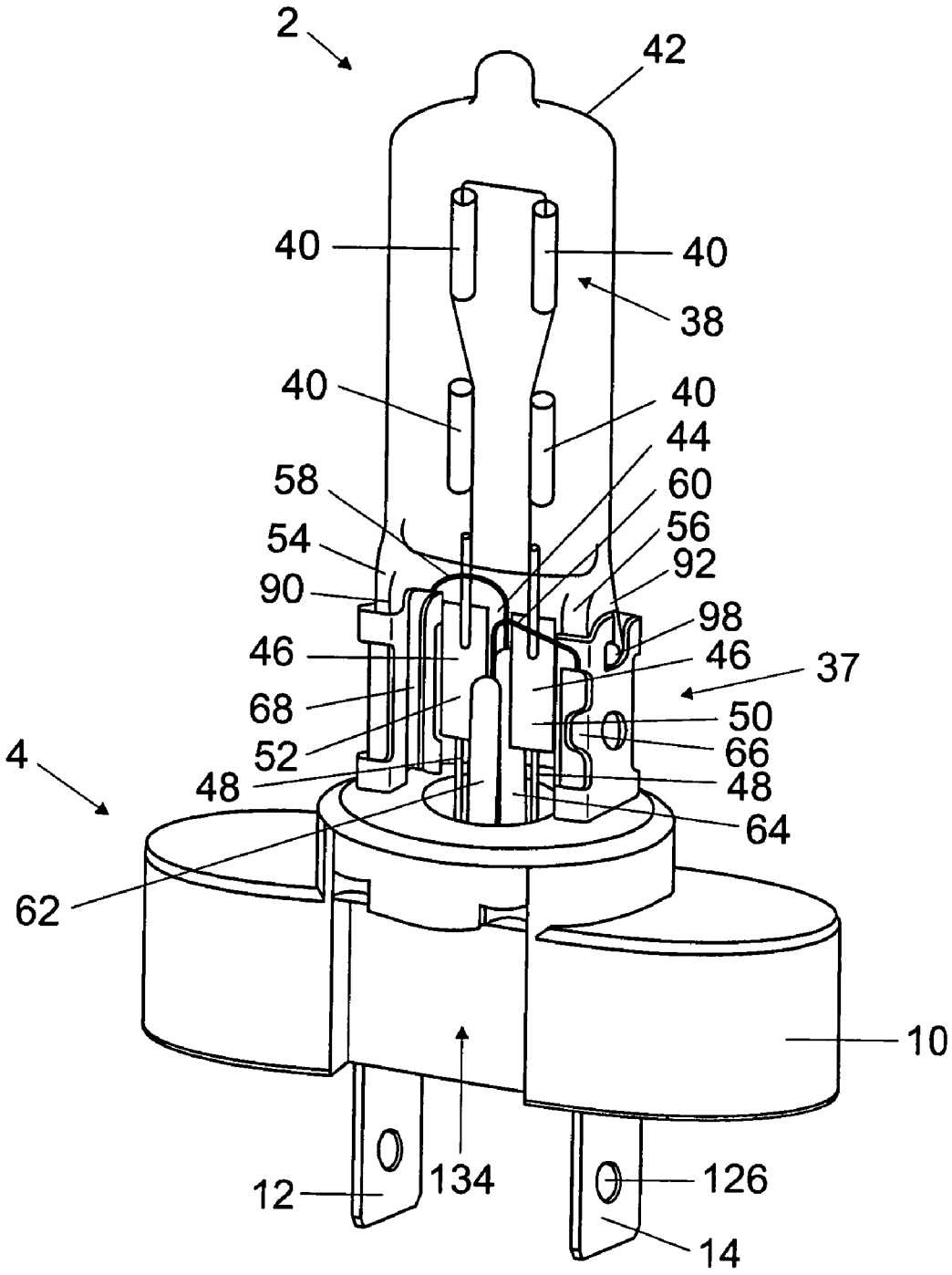
FIG. 6 shows a three-dimensional view of a base arrangement according to the invention having an integral lamp inserted.

FIG. 6 shows a three-dimensional illustration of the base arrangement 4 according to the invention with an integral lamp 2 inserted, the two physically identical contact springs 12, 14 in the form of stamped and bent sheet-metal parts being snapped into the ceramic base 10 of the base arrangement 4 in the form of a contact spring arrangement 37 and taking on the functions both of making electrical contact with and of mechanically fixing the integral lamp 2 in the reflector 6.

In the exemplary embodiment illustrated, the integral lamp 2 is in the form of a halogen incandescent lamp (halogen burner) using the knob technique.

Such a halogen incandescent lamp 2 essentially comprises a filament 38, which is divided up into four filament sections 40, for example, and is fixed in position in a bulb 42 by means of the knob technique. This bulb 42 is sealed off by means of a pinch seal 44 at one end, the two end sections of the filament 38 being connected to contact pins 48 passed out of the pinch seal via in each case one molybdenum foil 46 in said pinch seal 44. The pinch seal 44 is in this case designed such that the central region is formed with planar-parallel surfaces, which merge with edge sections 54, 56, which protrude perpendicularly beyond the two planar-parallel surfaces on both sides such that the cross section (not illustrated) of the pinch seal 44 is approximately in the form of a double T with the extended edge sections 54, 56 and the region lying therebetween which is delimited by the two planar-parallel surfaces. The two contact pins 48 are each welded to a power supply line 58, 60 having an integrated electrical fuse 62, 64, the power supply lines being passed back approximately in the form of a U in the direction of the two planar-parallel surfaces of the pinch seal 44 and being welded to contact lugs 66, 68 of the contact springs 12, 14.

Figure 7:
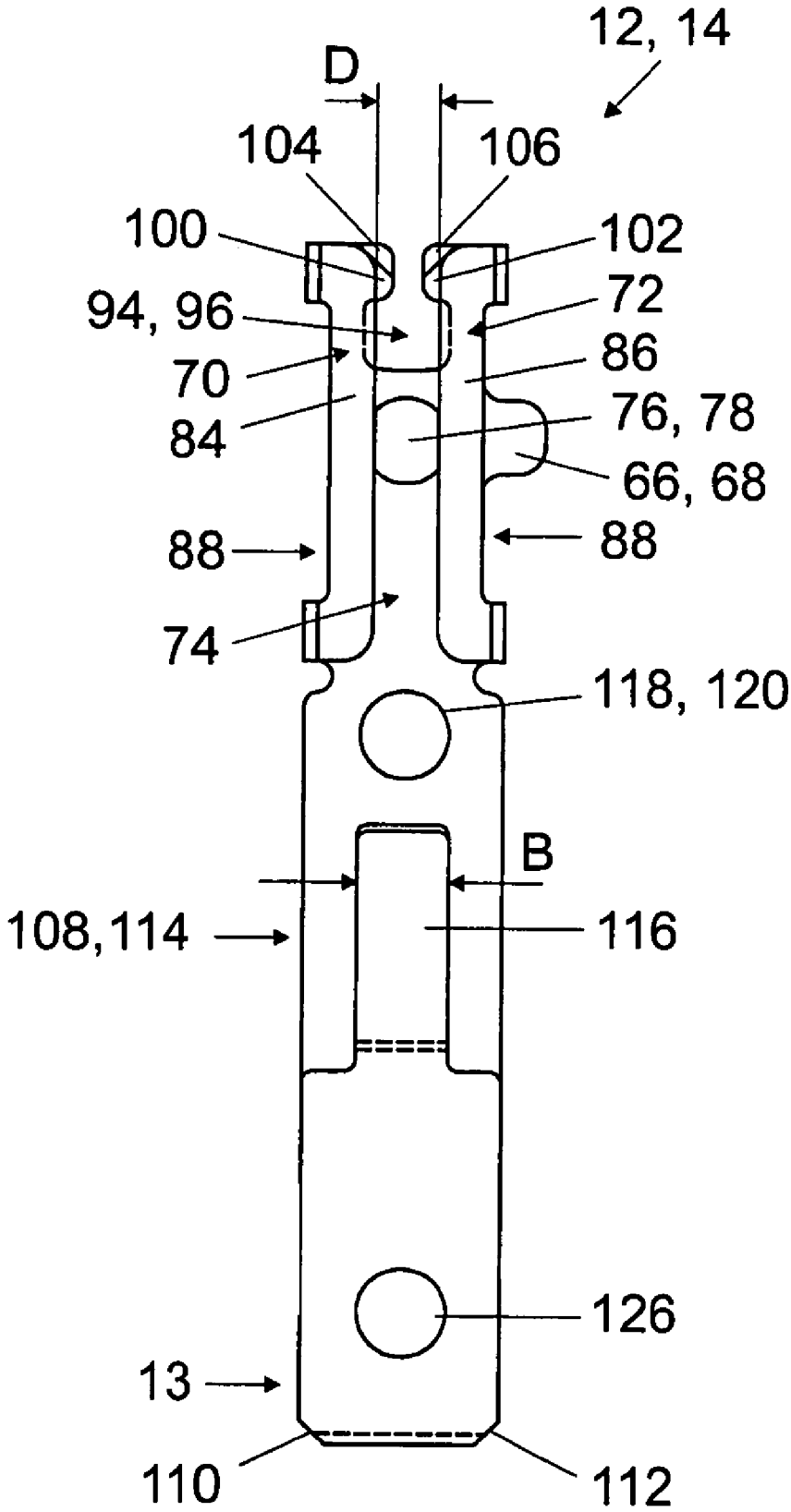
FIG. 7 shows a front view of a contact spring of the base arrangement.

As shown in FIG. 7, the contact springs 12, 14 inserted into the base arrangement 4 have an approximately rectangular basic shape with holding tabs 70, 72, which engage around the pinch seal 44 of the integral lamp 2 approximately in the form of a U on the outside and together form, on the lamp side, a clamping region 74. The integral lamp 2 is inserted into the clamping region 74 via the pinch seal 44, which is approximately in the form of a double T, and is held there via at least two knob-like projections 76, 78, formed in the clamping region 74, of the two contact springs which are brought to bear in a resilient manner against two side faces of the pinch seal 44, as shown in FIG. 6. In order to fix the integral lamp 2 in the radial direction, circumferential sections 84, 86, which are bent inwards towards one another, are formed in the clamping region 74 on each holding tab of the holding tabs 70, 72 such that said circumferential sections 84, 86 run approximately perpendicularly to the two planar-parallel surfaces of the pinch seal 44. The clear width D between the two edges of the circumferential sections 84, 86 approximately corresponds to the thickness of the pinch seal 44, i.e. to the distance between the two planar-parallel surfaces, with the result that the circumferential sections 84, 86 engage behind the two projecting edge sections 54, 56 of the pinch seal 44 when the integral lamp 2 is inserted. Each of the holding tabs 70, 72 is provided with a cutout 88 and bears in a resilient manner against the two projecting edge sections 54, 56 of the pinch seal 44 once the integral lamp 2 has been inserted, the pinch seal 44 passing diagonally through the clamping region 74, and the circumferential sections 84, 86 resting on in each case two inner surfaces 90, 92 of the pinch seal 44 such that the integral lamp 2 is fixed in position in the radial direction. The contact springs 12, 14 in this case make it possible to vary the installation position in the longitudinal direction of the reflector 6 and thus to adapt it to the dimensions of different integral lamps 2, for example with other pinch-seal lengths or contact-pin lengths.

In order to delimit the insertion depth of the integral lamp 2 in the contact spring arrangement 37, in each case an approximately slot-shaped insertion section 94, 96 is formed on the contact springs 12, 14, it being possible in each case for a knob 98 (cf. FIG. 6), which is formed on the two side faces of the pinch seal 44, of the integral lamp 2 to be inserted into said insertion section 94, 96 and fixed there. The insertion sections 94, 96 are delimited, on the lamp side, by two corner regions 100, 102, which protrude into the insertion section, engage behind the knobs 98 of the pinch seal 44 in the inserted state of the integral lamp 2 and hold said integral lamp 2 in the contact spring arrangement 37. In order to make it easier to insert the pinch seal 44 and the knobs 98, the corner regions 100, 102 are bent outwards at lamp-side sections 104, 106.

Figure 8:
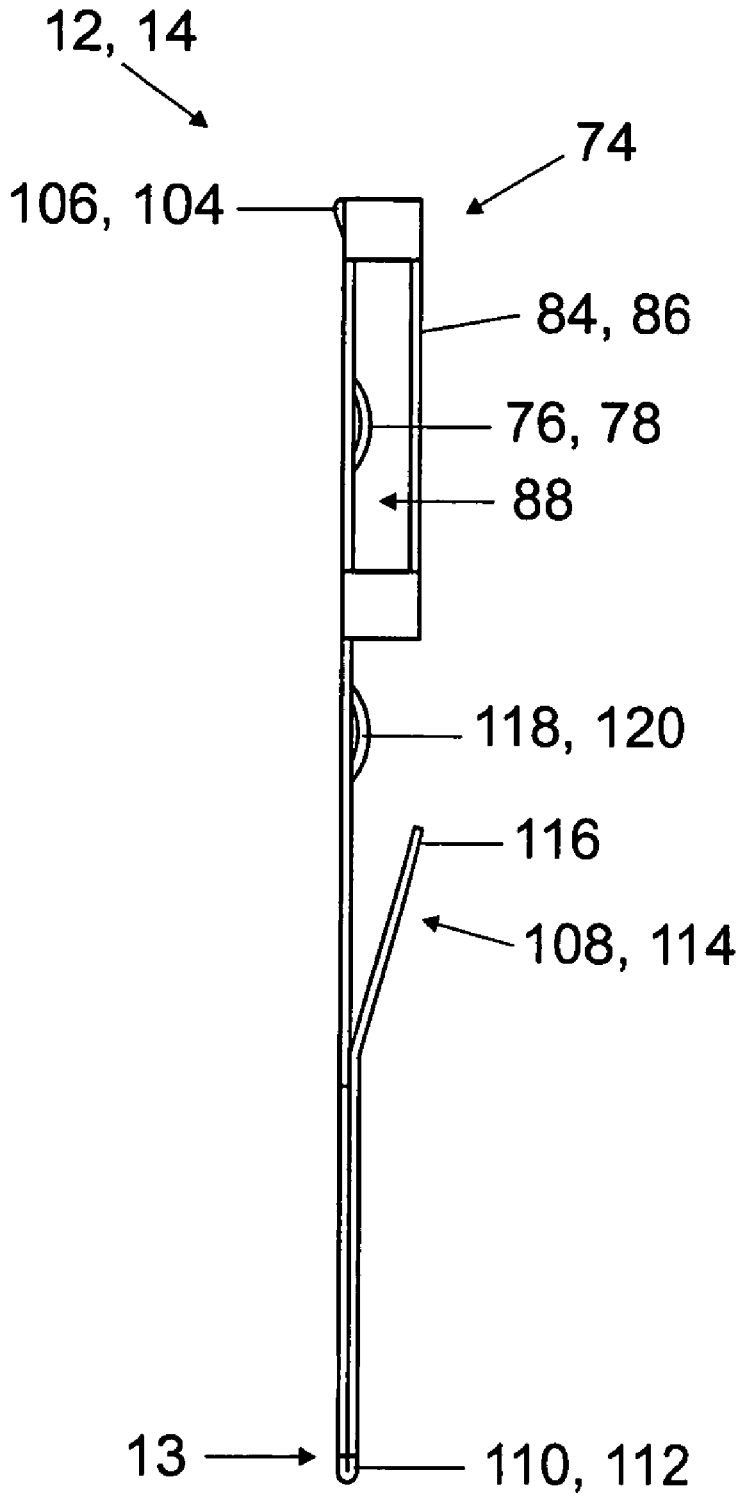
FIG. 8 shows a side view of the contact spring shown in FIG. 7.
Figure 10:
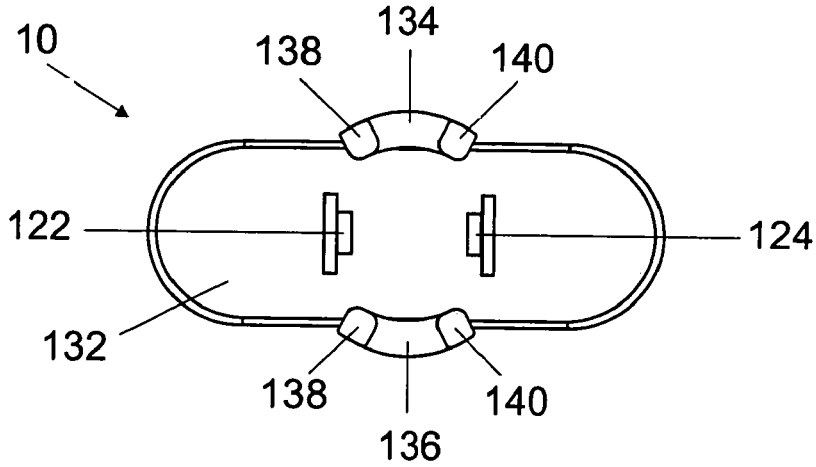
FIG. 10 shows a further view of the ceramic base shown in FIG. 9.
Figure 11:
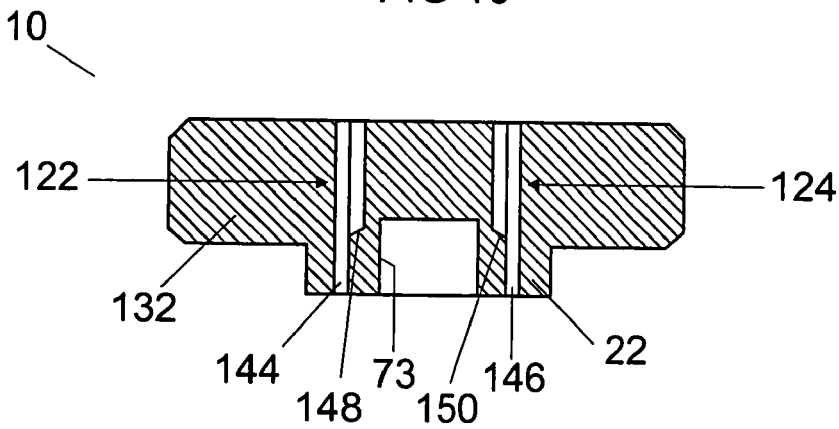
FIG. 11 shows a section A-A according to FIG. 9.

As can be seen in particular in FIG. 8, which shows a side view of a contact spring 12, 14 of the contact spring arrangement 37, said contact spring arrangement 37 is bent back at the end section 13 through 180° in the direction of the approximately bracket-shaped clamping region 74 and is bent out at a holding section 108, 114 to form a spring tab 116. The spring tabs 116 are designed such that they can be plugged into the ceramic base 10 and such that they latch into it. The spring tabs 116 have a smaller width B (cf. FIG. 7) than an end section 13 of the contact springs 12, 14. In a region between the clamping region 74 and the spring tab 116, a further knob-like projection 118, 120 is formed which can be brought into engagement with mounting cutouts 122, 124 in the ceramic base 10 (as shown in FIG. 10) and also fixes the contact springs 12, 14 in the ceramic base 10. In order to improve insertion of the contact springs 12, 14 into a plug (not illustrated) and to improve contact-making, said contact springs 12, 14 are provided with bevels 110, 112 and with a through-hole 126 at the end section 13 (cf. FIG. 7).

Figure 9:
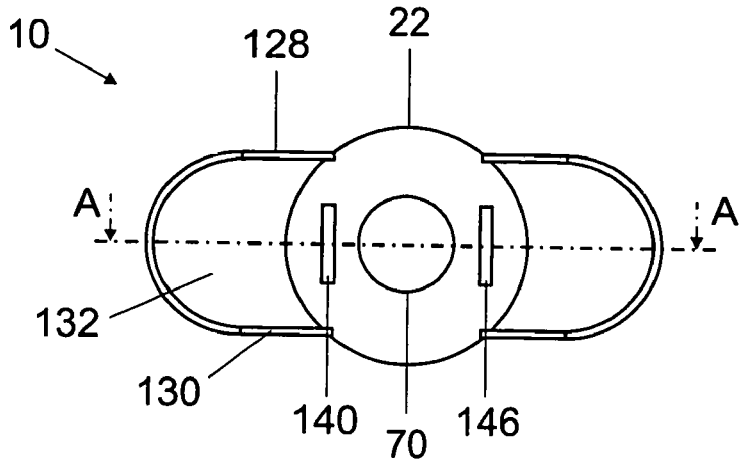
FIG. 9 shows a plan view of a ceramic base of the base arrangement shown in FIG. 6.

As shown in FIG. 9, the ceramic base 10 of the base arrangement 4 according to the invention has a basic body 132, which is delimited by two planar-parallel surfaces 128, 130, has a round end and merges with the approximately cylindrical holding region 22 having a larger diameter than the distance between the planar-parallel surfaces 128, 130 for the purpose of accommodating the reflector neck 20 (cf. FIG. 1). Cutouts 134, 136 are formed in the basic body 132 on both planar-parallel surfaces 128, 130, and continue in each case as two notches 138, 140 in the cylindrical holding region 22, into which two notches 138, 140 sections of the reflector neck 20 engage when the reflector 6 is crimped with the base arrangement 4 and form an interlocking connection (cf. FIG. 10).

FIG. 10 shows a view, from below, of the ceramic base 10, said ceramic base 10 having two parallel mounting cutouts 122, 124 for the purpose of accommodating the contact springs 12, 14. The cutouts 122, 124 run, with an approximately T-shaped cross section, diametrically spaced apart from one another along the longitudinal axis of the ceramic base 10 and extend, as can be seen in particular in FIG. 11, which shows the section A-A in FIG. 9, until they are approximately in the cylindrical holding region 22 of the base 10 and form slot-shaped sections 144, 146 in their further extent. The approximately T-shaped cross section of the mounting cutouts 122, 124 serve the purpose of accommodating the spring tabs 116, formed on the contact springs 12, 14, i.e. the spring tabs 116 snap into the ceramic base 10 in this region and secure the contact springs 12, 14 in the mounting cutout 122, 124. The spring tabs 116 and the mounting cutouts 122, 124 are preferably dimensioned such that the spring tab 116 engages behind the projections 148, 150 formed by the T-shaped and the slot-shaped section. In order to accommodate power supply lines 58, 60 and fuses 62, 64 of the integral lamp 2 which can be inserted into the base 10, the ceramic base 10 has a cutout 73 in the form of a blind hole which extends along its longitudinal axis. As a result, a low physical height of the integral lamp 2 inserted into the contact springs 12, 14 is achieved.

Figure 12:
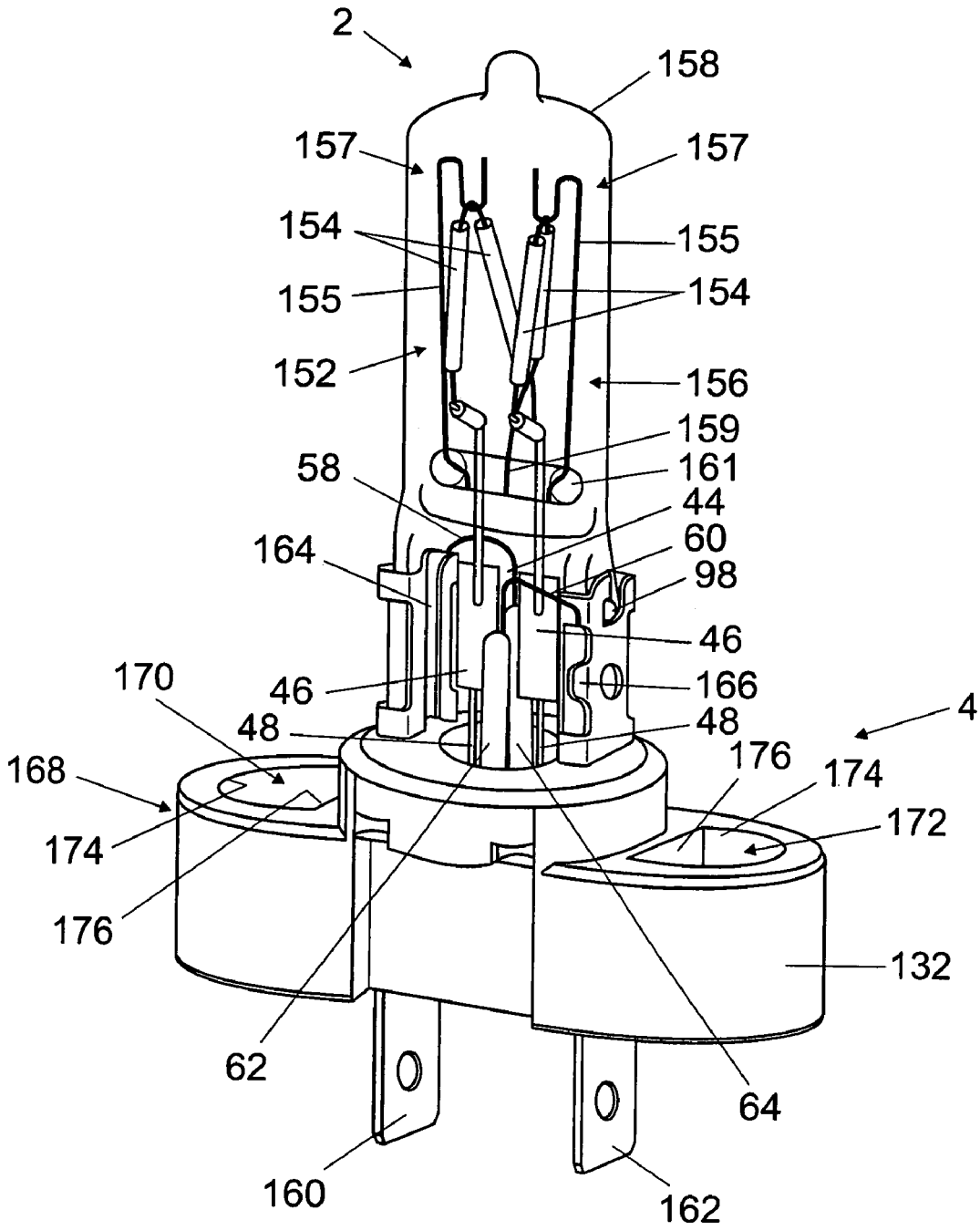
FIG. 12 shows a three-dimensional view of a base arrangement according to the invention of a further exemplary embodiment of a PAR lamp arrangement.
Figure 13:
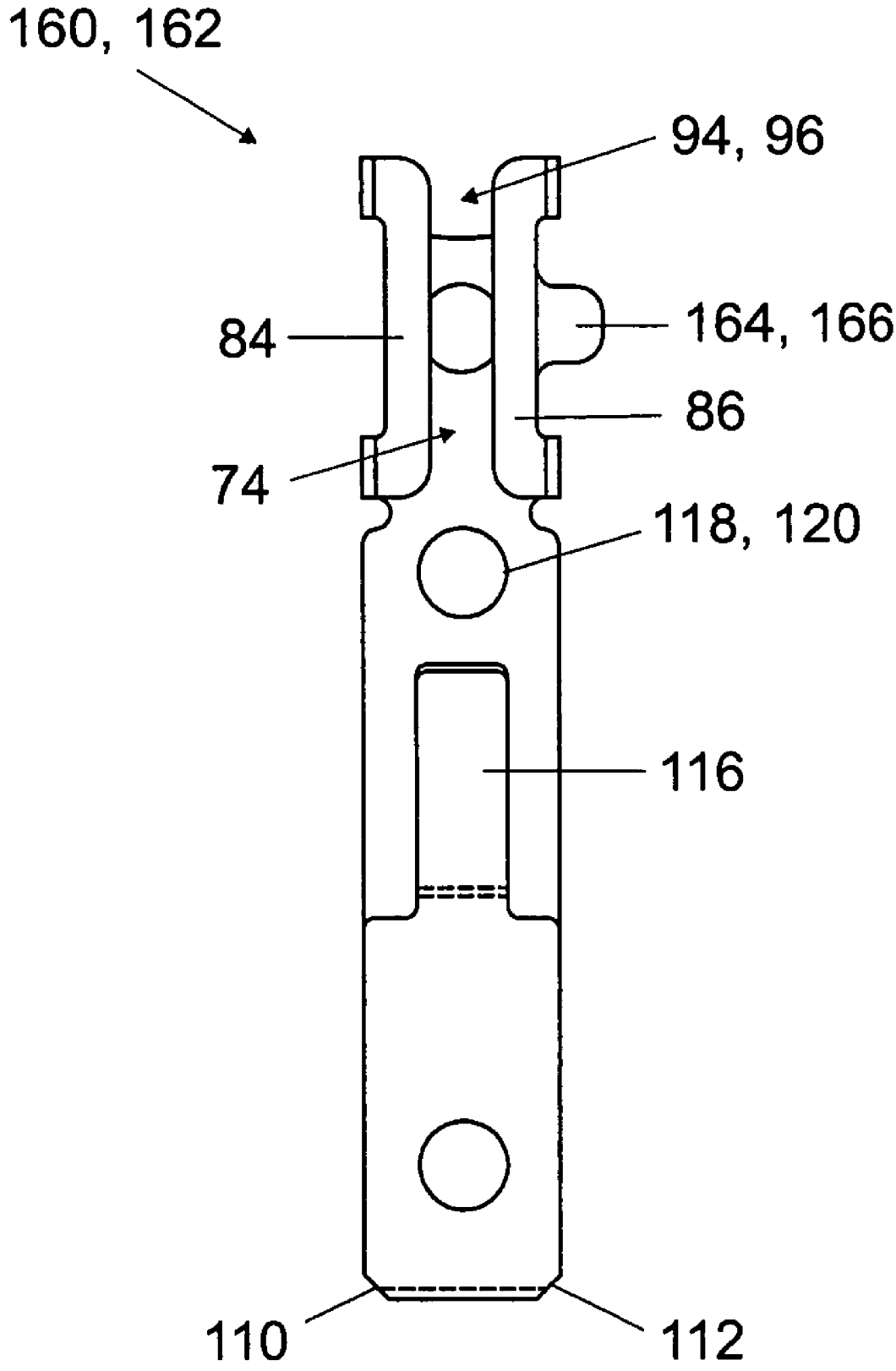
FIG. 13 shows a front view of a contact spring of the base arrangement shown in FIG. 12.

One exemplary embodiment of a PAR lamp arrangement is illustrated in FIGS. 12 to 13, in which embodiment the integral lamp 2 is designed to have a bar frame for the purpose of holding the filament.

As shown in FIG. 12, which shows a three-dimensional view of a base arrangement 4 according to the invention, the integral lamp 2 is in the form of a halogen incandescent lamp (halogen burner) using the bar-frame technique. Such a halogen incandescent lamp 2 has a filament 152, which is provided, for example, with four filament sections 154 and is fixed in position in a bulb 158 via a bar frame 156, which has two filament holders 155 having approximately U-shaped curvatures 157 and a hook-like holding element 159. The two filament holders 155 and the holding element 159 are fixed in their position in relation to one another by a transverse bar 161 made from quartz glass, the two filament holders 155 lying in one plane. The bulb 158 is sealed off by means of a pinch seal 44 (already explained in FIG. 6) at one end, the two end sections of the filament 152 being connected in said pinch seal 44 to contact pins 48 passed out of the pinch seal via power supply lines and in each case one molybdenum foil 46. The two contact pins 48 are each welded to a power supply line 58, 60 having an integrated electrical fuse, the power supply lines being passed back approximately in the form of a U in the direction of the pinch seal 44 and being welded to contact lugs 164, 166 arranged on contact springs 160, 162. The base arrangement 4 has a ceramic base 168, which differs from the ceramic base explained already in FIGS. 9 to 11 merely by two cutouts 170, 172 provided in the basic body 132. These cutouts 170, 172 are formed so as to pass through the basic body 132 and have, in plan view, in each case an approximately semicircular section 174, which is delimited by a straight section 176, the two straight sections 176 running essentially parallel to one another. The two cutouts 170, 172 save on material and bring about a further reduction in the weight of the PAR lamp arrangement.

FIG. 13 shows a view from the front of one of the two contact springs 160, 162 of the base arrangement 4 shown in FIG. 12. In order to delimit the insertion depth of the integral lamp 2 in the contact spring arrangement, in each case one approximately slot-shaped insertion section 94, 96 is formed on the contact springs 160, 162, it being possible for in each case one knob 98 (cf. FIG. 12), which is formed on the two side faces of the pinch seal 44, of the integral lamp 2 to be inserted in said insertion section 94, 96. The contact springs 160, 162 differ from the contact springs already described in FIGS. 7 and 8 essentially by the fact that the insertion sections 94, 96 are not delimited, on the lamp side, by corner regions (cf. FIG. 7) protruding into the insertion section, i.e. the knobs 98 of the pinch seal 44 merely bear against the insertion sections in the inserted state of the integral lamp 2 (cf. FIG. 12). This makes it possible to position the integral lamp 2 in the contact spring arrangement in a defined manner.

Mounting of the PAR lamp arrangement 1 is similar in both above-described exemplary embodiments and has essentially the following steps: in a first working step, the two contact pins 48 of the integral lamp 2 are each welded to a power supply line 58, 60 having an integrated electrical fuse 62, 64, and the power supply lines 58, 60 are bent back approximately in the form of a U in the direction of the two planar-parallel surfaces 50, 52 of the pinch seal 44. Subsequently, the contact springs 12, 14 or 160, 162 are inserted into the ceramic base 10; 168 and, owing to the engagement of the spring tabs 116 in the base 10, are connected to said base 10 to form a contact spring arrangement 37. In an independent working step, the diffusing screen 16 is inserted into the cylindrical circumferential wall 26 of the aluminum reflector 6 and is connected to the reflector 6 by means of beading on a circumferential section 30. In the following working step, the integral lamp 2 is inserted into the contact spring arrangement 37, and the power supply lines 58, 60 are connected to the contact lugs 66, 68 of the contact springs 12, 14 or 160, 162. Finally, the reflector 6 is pushed onto the holding region 22 of the ceramic base 10; 168 and connected to said ceramic base 10; 168 by means of crimping. The sequence of the mentioned mounting steps is in this case not essential, but can be matched to the production methods used.

The base arrangement according to the invention is not restricted to the described halogen incandescent lamps; rather any integral lamp known from the prior art can be used.

The subject matter of the disclosure is a PAR lamp arrangement 1 having an integral lamp 2, in particular an integral halogen lamp, which is inserted into a base 10; 168 and is surrounded at least in sections by a reflector 6, the base 10; 168 and the integral lamp 2 being connected via contact springs 12, 14; 160, 162, and the reflector 6 being covered by a diffusing screen 16. According to the invention, the reflector 6 is made from aluminum and is provided with a reflective surface or coating 8. Owing to the aluminum reflector 6 used and the fact that the integral lamp 2 is held via contact springs 12, 14; 160, 162, improved holding of the integral lamp 2 is made possible with reduced weight and production complexity.

What is claimed is:

1. A PAR lamp arrangement having an integral lamp, in particular an integral halogen lamp, which is inserted into a base and is surrounded at least in sections by a reflector, the base and the integral lamp being connected via contact springs, and the reflector being covered by a diffusing screen, whereby the reflector is made from aluminum and has a reflective surface or coating, the base and the integral lamp being connected via a contact spring arrangement, the contact spring arrangement having at least one slot-shaped insertion section, it being possible for at least one knob of the pinch seal of the integral lamp to be inserted into said insertion section and fixed there.

2. The PAR lamp arrangement as claimed in claim 1, the insertion section being delimited, on the lamp side, by corner regions which each engage behind the knob of the pinch seal and hold the integral lamp in the contact spring arrangement.

3. The PAR lamp arrangement as claimed in claim 2, the corner regions being bent outwards, on the lamp side, at least in sections.

4. A PAR lamp arrangement having an integral lamp, in particular an integral halogen lamp, which is inserted into a base and is surrounded at least in sections by a reflector, the base and the integral lamp being connected via contact springs, and the reflector being covered by a diffusing screen, whereby the reflector is made from aluminum and has a reflective surface or coating, the base and the integral lamp being connected via a contact spring arrangement, the contact spring arrangement having at least two contact lugs for the purpose of making electrical contact with the integral lamp.

5. The PAR lamp arrangement as claimed in claim 4, the contact springs each forming at least one spring tab, which is bent out for the purpose of being connected to the base.

6. The PAR lamp arrangement as claimed in claim 4, the contact springs being in the form of stamped and bent sheet-metal parts and having an approximately bracket-shaped cross section, at least in sections.

7. A PAR lamp arrangement having an integral lamp, in particular an integral halogen lamp, which is inserted into a base and is surrounded at least in sections by a reflector, the base and the integral lamp being connected via contact springs, and the reflector being covered by a diffusing screen, whereby the reflector is made from aluminum and has a reflective surface or coating, the integral lamp having two contact pins, which emerge on the underside of the pinch seal and are each provided with a power supply line having an integrated electrical fuse, and the power supply lines being passed back in the direction of two planar-parallel surfaces of the pinch seal.

8. The PAR lamp arrangement as claimed in claim 7, the power supply lines being electrically connected, preferably welded or soldered, to contact lugs of the contact springs.

* * * * *

UNITED STATES PATENT AND TRADEMARK OFFICE

CERTIFICATE OF CORRECTION

PATENT NO. : 7,511,410 B2
APPLICATION NO. : 11/302153
DATED : March 31, 2009
INVENTOR(S) : Josef Bauer et al.

It is certified that error appears in the above-identified patent and that said Letters Patent is hereby corrected as shown below:

Please correct the Assignee's name, line item (73) on the Title page of the patent, to read as follows:

--OSRAM Gesellschaft mit beschraenkter Haftung--

Signed and Sealed this

Tenth Day of November, 2009

David J. Kappos

David J. Kappos
*Director of the United States Patent and Trademark Office*